US010497303B2

(12) United States Patent
Li et al.

(10) Patent No.: US 10,497,303 B2
(45) Date of Patent: Dec. 3, 2019

(54) METHOD AND DEVICE FOR ALWAYS ON DISPLAY, AND COMPUTER-READABLE STORAGE MEDIUM

(71) Applicant: BEIJING XIAOMI MOBILE SOFTWARE CO., LTD., Beijing (CN)

(72) Inventors: Guosheng Li, Beijing (CN); Shaoxiong Zhu, Beijing (CN); Weiyan Ge, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 15/981,337

(22) Filed: May 16, 2018

(65) Prior Publication Data

US 2019/0012954 A1 Jan. 10, 2019

(30) Foreign Application Priority Data

Jul. 4, 2017 (CN) ..... 2017 1 0539064

(51) Int. Cl.

*G09G 3/00* (2006.01)
*G09G 3/20* (2006.01)
*G09G 3/36* (2006.01)

(52) U.S. Cl.

CPC ..... *G09G 3/2096* (2013.01); *G09G 3/36* (2013.01); *G09G 2370/10* (2013.01)

(58) Field of Classification Search

None

See application file for complete search history.

(56) References Cited

U.S. PATENT DOCUMENTS 6,968,158 B1 * 11/2005 Bhuta ..... H04W 4/20 455/566
7,107,063 B1 * 9/2006 Bates ..... H04B 1/16 455/154.1
2006/0202938 A1 * 9/2006 Chen ..... G09G 3/3611 345/100
2006/0245723 A1 * 11/2006 Yahata ..... G11B 19/025 386/243

(Continued)

OTHER PUBLICATIONS

Extended European Search Report dated Nov. 7, 2018 in European Patent Application No. 18180743.9, 9 pages.

*Primary Examiner* — Martin Mushambo
(74) *Attorney, Agent, or Firm* — Oblon, McClelland, Maier & Neustadt, L.L.P.

(57) ABSTRACT

The disclosure relates to a method and a device for always on display, and a computer-readable storage medium. The method includes transmitting at least one data packet to a liquid crystal display module (LCM) via a mobile industry processor interface (MIPI) protocol; and displaying an information content by the LCM through an always on display function based on the at least one data packet that includes data required for always on display, wherein the data packet further includes a first field and a second field for each of the at least one data packet, the first field and the second field both are fields predefined for the always on display function in a display command set (DCS) of the MIPI protocol, the first field is configured to indicate the data packet to be a data packet for performing always on display, and the second field is configured to indicate a type of data included in the data packet.

11 Claims, 6 Drawing Sheets

(56) References Cited

U.S. PATENT DOCUMENTS

| | | | | |
|---|---|---|---|---|
| 2009/0207277 | A1* | 8/2009 | Kurihara | H04N 5/232 348/231.4 |
| 2009/0235120 | A1* | 9/2009 | Gettemy | G06F 11/2733 714/30 |
| 2012/0182967 | A1* | 7/2012 | Sato | H04W 4/06 370/331 |
| 2014/0063033 | A1* | 3/2014 | Bae | G06T 1/60 345/545 |
| 2015/0228239 | A1 | 8/2015 | Tanaka et al. | |
| 2015/0235343 | A1* | 8/2015 | Asai | G06T 1/60 345/534 |
| 2016/0055830 | A1* | 2/2016 | Lee | G09G 5/006 345/1.3 |
| 2016/0293096 | A1 | 10/2016 | Nose | |

* cited by examiner

METHOD AND DEVICE FOR ALWAYS ON DISPLAY, AND COMPUTER-READABLE STORAGE MEDIUM

CROSS-REFERENCE TO RELATED APPLICATIONS

This application is based on and claimed priority to Chinese Patent Application Serial No. 201710539064.2, filed on Jul. 4, 2017, the entire contents of which are incorporated herein by reference.

TECHNICAL FIELD

The present disclosure generally relates to a field of information processing, and more particularly to a method and a device for always on display, and a computer-readable storage medium.

BACKGROUND

As smart terminals such as smart phones, tablet PCs are widely used, users rely more and more on smart terminals. According to statistics, a user looks over his/her smart phone about 150 times per day by lighting up the screen thereof, while most users view the smart phone just to check time and notification messages, so a method for always on display is provided in order to help the users to obtain time and notification messages.

In the related art, only a part of the area of the screen of the smart terminals may be kept continuously lit so as to display time and notification messages. Among the smart terminals, the current accurate time may be acquired by Application Processor (AP) every minute, a picture may be drawn according to the acquired time and a preset display format to obtain a current display image. Afterwards, the current display image is transmitted to the Liquid Crystal Display Module (LCM) by the AP of the smart terminal according to an image updating command in the Display Command Set (DCS) of the Mobile Industry Processor interface (MIPI), in order to display by the LCM according to the current display image.

SUMMARY

This Summary is provided to introduce a selection of aspects of the present disclosure in a simplified form that are further described below in the Detailed Description. This Summary is not intended to identify key features or essential features of the claimed subject matter, nor is it intended to be used to limit the scope of the claimed subject matter.

In order to overcome the problem of low efficiency of research and development due to lack of unified communication interfaces when performing an always on display function in an AP and a LCM of a smart terminal, there are provided a method and a device for always on display, and a computer-readable storage medium in the present disclosure.

Aspects of the disclosure provide a method for always on display, being applicable to an application processor (AP). The method includes transmitting at least one data packet to a liquid crystal display module (LCM) via a mobile industry processor interface (MIPI) protocol; and displaying an information content by the LCM through an always on display function based on the at least one data packet that includes data required for always on display, wherein the data packet further includes a first field and a second field for each of the at least one data packet, the first field and the second field both are fields predefined for the always on display function in a display command set (DC S) of the MIPI protocol, the first field is configured to indicate the data packet to be a data packet for performing always on display, and the second field is configured to indicate a type of data included in the data packet.

In an example, a value of the first field is a first preset value or a second preset value, the first preset value is configured to indicate the data packet to be a first one of the at least one data packet, and the second preset value is configured to indicate the data packet to be a following data packet of a previous data packet adjacent to the data packet.

In another example, a value of the second field is a first preset value, a second preset value or a third preset value, the first preset value is configured to indicate the type of the data included in the data packet to be initialization data, the second preset value is configured to indicate the type of the data included in the data packet to be time calibration data, and the third preset value is configured to indicate the type of the data included in the data packet to be picture update data.

According to an aspect, when transmitting the at least one data packet to the LCM via the MIPI protocol, the method includes transmitting the at least one data packet to the LCM via the MIPI protocol when initialization of the LCM is completed or the always on display function is enabled, wherein the at least one data packet comprises data required for always on display within a preset time period from a current system time, and the value of the second field of the at least one data packet is the first preset value.

According to another aspect, after transmitting the at least one data packet to the LCM via the MIPI protocol, the method includes retrieving a system time once every first preset time interval; and transmitting a data packet comprising the retrieved system time to the LCM via the MIPI protocol, a value of the second field of the data packet comprising the retrieved system time being the second preset value.

According to yet another example, after transmitting the at least one data packet to the LCM via the MIPI protocol, the method includes detecting whether picture data required for always on display are updated according to a preset period; and transmitting a data packet comprising the updated picture data to the LCM when it is detected that the picture data required for always on display are updated, a value of the second field of the data packet comprising the updated picture data being the third preset value.

Aspects of the disclosure also provide a device for always on display. The device includes a processor and a memory for storing instructions executable by the processor. The processor is configured to transmit at least one data packet to a liquid crystal display module (LCM) via a mobile industry processor interface (MIPI) protocol; and display an information content by the LCM through an always on display function based on the at least one data packet that includes data required for always on display, wherein the data packet further includes a first field and a second field for each of the at least one data packet, the first field and the second field both are fields predefined for the always on display function in a display command set (DCS) of the MIPI protocol, the first field is configured to indicate the data packet to be a data packet for performing always on display, and the second field is configured to indicate a type of data included in the data packet.

Aspects of the disclosure also provide a non-transitory computer-readable storage medium having stored therein instructions that, when executed by a processor one or more processors of a computing device, cause the computing device to transmit at least one data packet to a liquid crystal display module (LCM) via a mobile industry processor interface (MIPI) protocol; and display an information content by the LCM through an always on display function based on the at least one data packet that includes data required for always on display, wherein the data packet further includes a first field and a second field for each of the at least one data packet, the first field and the second field both are fields predefined for the always on display function in a display command set (DCS) of the MIPI protocol, the first field is configured to indicate the data packet to be a data packet for performing always on display, and the second field is configured to indicate a type of data included in the data packet.

It is to be understood that both the foregoing general description and the following detailed description are illustrative and explanatory only and are not restrictive of the present disclosure.

BRIEF DESCRIPTION OF THE DRAWINGS

The accompanying drawings, which are incorporated in and constitute a part of this specification, illustrate aspects consistent with the disclosure and, together with the description, serve to explain the principles of the disclosure.

Figure 1:
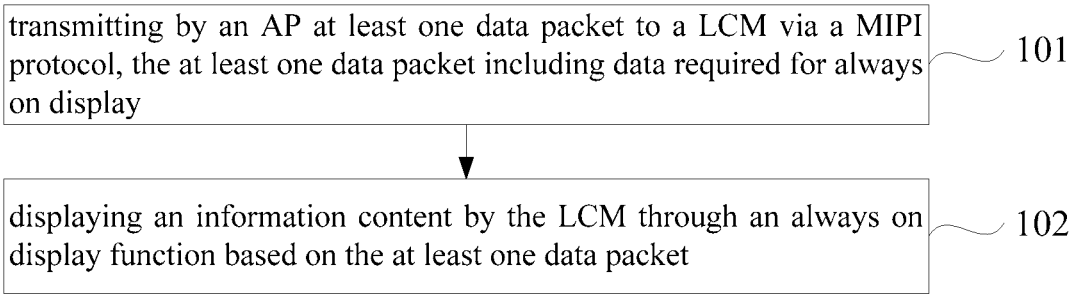
FIG. 1 is a flow chart showing a method for always on display, according to an exemplary aspect of the present disclosure.

The specific aspects of the present disclosure, which have been illustrated by the accompanying drawings described above, will be described in detail below. These accompanying drawings and description are not intended to limit the scope of the present disclosure in any manner, but to explain the concept of the present disclosure to those skilled in the art via referencing specific aspects.

DETAILED DESCRIPTION

Reference will now be made in detail to exemplary aspects, examples of which are illustrated in the accompanying drawings. The following description refers to the accompanying drawings in which the same numbers in different drawings represent the same or similar elements unless otherwise represented. The implementations set forth in the following description of illustrative aspects do not represent all implementations consistent with the disclosure. Instead, they are merely examples of apparatuses and methods consistent with aspects related to the disclosure as recited in the appended claims.

Prior to the detailed explanation of the aspects in the present disclosure, application scenarios of the aspects in the present disclosure will be described. Smart terminals (e.g., smart phones and tablet PCs) are widely used in daily life. All kinds of information may be obtained by the user through a smart terminal. When a screen of the smart terminal is gone out, an always on display function is provided for the current smart terminal in order to make users directly view the current time, or whether there is basic information such as notification messages without lighting the screen. It should be noted that the always on display function of the smart terminal is implemented through an AP and a LCM of the smart terminal together, that is, the AP of the smart terminal transmits display data to the LCM, and then the information content is displayed by the LCM according to the display data. The method for always on display according to the aspects of the present disclosure may be applied to the AP of the smart terminal in the above scenarios, so that the AP of the smart terminal may transmit the display data to the LCM more flexibly in order to implement always on display by the LCM according to the display data.

When a smart terminal performs always on display after the screen is gone out, an AP of the smart terminal will draw a full-size image required for always on display once per minute according to the current time. Afterwards, the AP may transmit the drawn full-size image to the LCM via a pre-existing image updating command in the MIPI, and the full-size image may be directly displayed by the LCM. That is, there is no specific command for realization of the always on display function in the DCS of the current MIPI protocol, and then AP may only transmit a full-size image required to display according to the existing general image updating command in the MIPI protocol, so the image updating manner lacks flexibility. Moreover, the updating of the full-size image performed per minute needs to transmit too many data, and an update period is too short, and thus the power consumption of the smart terminal is too large. If it is updated via other protocols, the efficiency of research and development of the AP and the LCM will be reduced due to lacking of unified communication interfaces when the always on display function is implemented, because manufacturers of the AP and the LCM may not be the same manufacturer.

In order to solve the above-mentioned technical problems, in the present aspect, a method for always on display is provided. The method for always on display will be described below in detail by the following aspects in conjunction with the drawings.

FIG. 1 is a flow chart showing a method for always on display, according to an exemplary aspect. Referring to FIG. 1, the method is applied to a smart terminal and includes the following steps.

In step 101, at least one data packet is transmitted by an AP to a LCM through a MIPI protocol, in which the at least one data packet includes data required for always on display.

The data packet further carries a first field and a second field for each of the at least one data packet, the first field and the second field both are fields predefined for the always on display function in a display command set DCS of the MIPI protocol, the first field is configured to indicate the data packet to be a data packet for performing always on display, and the second field is configured to indicate a type of data included in the data packet.

In step 102, an information content is displayed by the LCM through an always on display function based on the at least one data packet.

In an aspect of the present disclosure, a dedicated first field and a dedicated second field are defined for an always on display function in a display command set DCS of the MIPI protocol. When at least one data packet including data required for always on display is transmitted by the AP to the LCM, the data packet may carry a first field and a second field configured to indicate the data packet to be a data packet for performing always on display and to indicate a type of data included in the data packet. That is, by means of the method according to the present aspect, MIPI communication interfaces having an always on display function are unified, the AP and LCM can be developed by each manufacturer according to the unified communication interfaces so as to implement the always on display function, and thus the efficiency of research and development may be improved. Further, because a type of data included in the data packet may be indicated via the second field, the data required for always on display can be sub-packaged and transmitted by the AP according to the type of data, thus increasing the flexibility of always on display.

Alternatively, a value of the first field is a first preset value or a second preset value, the first preset value is configured to indicate the data packet to be a first one of the at least one data packet, and the second preset value is configured to indicate the data packet to be a following data packet of a previous data packet adjacent to the data packet.

Alternatively, a value of the second field is a third preset value, a fourth preset value or a fifth preset value, the third preset value is configured to indicate the type of the data included in the data packet to be initialization data, the fourth preset value is configured to indicate the type of the data included in the data packet to be time calibration data, and the fifth preset value is configured to indicate the type of the data included in the data packet to be picture update data.

Alternatively, transmitting the at least one data packet to the liquid crystal display module LCM via the mobile industry processor interface MIPI protocol includes: transmitting the at least one data packet to the LCM via the MIPI protocol when the initialization of the LCM is completed or the always on display function is enabled, in which the at least one data packet includes data required for always on display within a preset time period from a current system time, and the value of the second field of the at least one data packet is the third preset value.

Alternatively, after transmitting the at least one data packet to the LCM via the MIPI protocol, the method further includes: retrieving a system time once every first preset time interval; transmitting a data packet including the retrieved system time to the LCM via the MIPI protocol, a value of the second field of the data packet including the retrieved system time being the fourth preset value.

Alternatively, after transmitting the at least one data packet to the LCM via the MIPI protocol, the method further includes: detecting whether picture data required for always on display are updated according to a preset period; and transmitting a data packet including the updated picture data to the LCM when it is detected that the picture data required for always on display are updated, a value of the second field of the data packet including the updated picture data being the fifth preset value.

Figure 2:
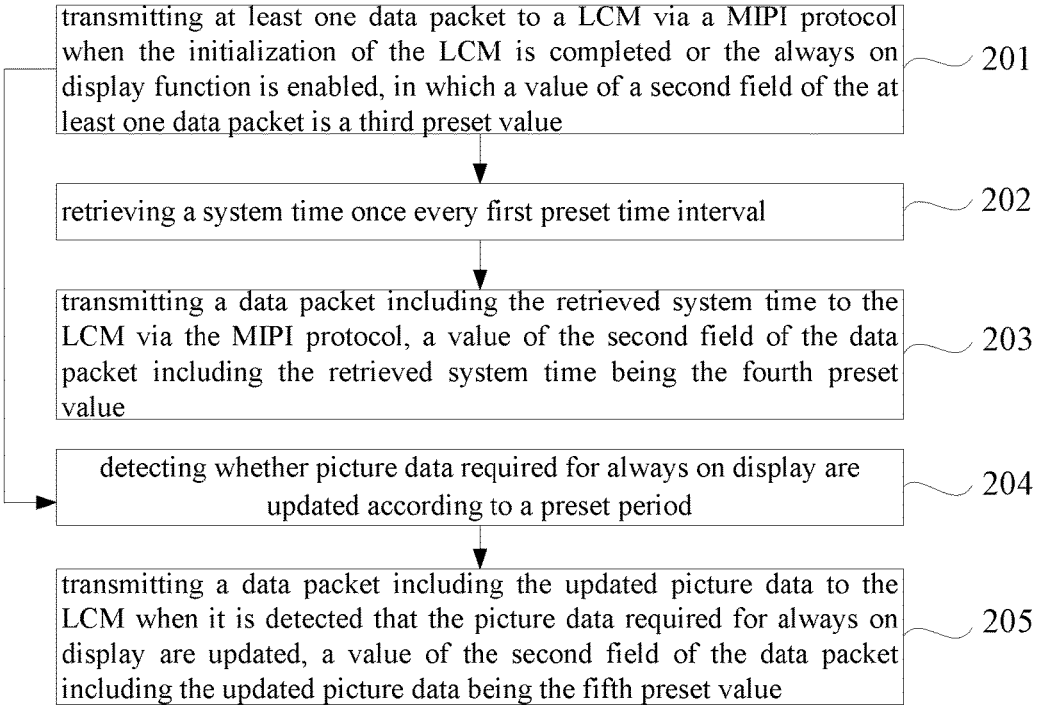
FIG. 2 is a flow chart showing another method for always on display, according to an exemplary aspect of the present disclosure.

FIG. 2 is a flow chart showing another method for always on display, according to an exemplary aspect. Referring to FIG. 2, the method is applied to an AP and includes the following steps.

In step 201, at least one data packet is transmitted to a LCM via a MIPI protocol when the initialization of the LCM is completed or an always on display function is enabled, a value of the second field of the at least one data packet is a third preset value.

In an aspect of the present disclosure, in order to reduce the power consumption of a smart terminal when performing always on display, i.e., in order to prevent an AP from drawing an entire image per minute, at least one data packet is transmitted to the LCM by the AP before performing always on display, in which the at least one data packet may include all the data required for always on display. Of course, because an image storage space of the LCM is small, and because the previously stored always on display data may be deleted by the LCM each time the screen is lighted, the at least one data packet may include only data required for always on display within a preset time period from a current system time in order to save storage space and prevent the unused data from being deleted after transmitting too much data. The preset time period may be one hour or two hours, and is not limited by the present disclosure.

In addition, before always on display is performed by the LCM, different occasions may be chosen by the AP to transmit at least one packet to the LCM. When a screen of the smart terminal is gone out, a value in a register may be set by the LCM according to an initialization code, and after the initialization is completed, at least one data packet is transmitted by the AP to the LCM via a MIPI protocol. Alternatively, when a current always on display function being enabled is detected by the AP, at least one packet may be transmitted by the AP to the LCM via the MIPI protocol.

It should be noted that for each of the at least one data packet, the data packet includes data required for always on display, and at the same time, the packet may carry a first field and a second field, the first field and the second field both are fields predefined for the always on display function in a display command set DCS of the MIPI protocol, the first field is configured to indicate the data packet to be a data packet for performing always on display, and the second field is configured to indicate a type of data included in the data packet.

A value of the first field may be a first preset value or a second preset value, the first preset value is configured to indicate the data packet to be a first one of the at least one data packet, and the second preset value is configured to indicate the data packet to be a following data packet of a previous data packet adjacent to the data packet. A value of the second field is a third preset value, a fourth preset value or a fifth preset value, the third preset value is configured to indicate the type of the data included in the data packet to be initialization data, the fourth preset value is configured to indicate the type of the data included in the data packet to be time calibration data, and the fifth preset value is configured to indicate the type of the data included in the data packet to be picture update data.

In general, when the AP transmits all or part of the data required for always on display to the LCM, the AP may not be able to transmit all the data through one data packet because of the limited size of the packet. At this time, the AP transmits a plurality of data packets so as to transmit all or part of the data required for always on display to the LCM. When the AP transmits a plurality of data packets, for the first data packet of the plurality of data packets, the AP may carry a first field in the first data packet and set a value of the first field to a first preset value, in order to identify the data packet to be a data packet for performing always on display and to be the first data packet in the plurality of data packets. For the data packet after the first data packet, the AP may set the first field in the subsequent data packet to the second preset value so as to identify the data packet to be a following data packet of a previous data packet adjacent to the data packet. For example, for the second data packet in the plurality of data packets, the first field carried by the same may be set to a second preset value so as to identify the data packet to be a following data packet of the first data packet, and the subsequent data packets can be done in the same manner. Of course, if the AP only transmits one data packet, then the first field carried by the data packet may also be set to the first preset value.

It should be noted that the AP may also include a second field in the transmitted at least one data packet, and the type of data included in each data packet may be identified by taking different values for the second field carried in each data packet.

In this step, when it is detected that the initialization of the LCM is completed or the always on display function is enabled, the at least one data packet transmitted by the AP to the LCM is a data packet including all the data required for always on display, or a data packet including all the data for always on display within a preset time period. That is, the data included in the at least one data packet transmitted by the AP to the LCM are the data necessary for the start of the always on display function. Therefore, for each of the at least one data packet, the AP may carry a second field with the third preset value in the data packet so as to identify the type of the data included in the data packet to be initialization data.

It should be noted that the initialization data may include a background image upon always on display, font bitmap (e.g., images of 0-9 and a-z, icons of various notification messages, etc.) often used for always on display, some setting data for always on display (e.g., font size, color, etc.), etc. In addition, the initialization data may include a reference time which is a current system time acquired by the AP. The LCM may be timed by its own crystal oscillator and may calculate a system time to be displayed at each moment according to the reference time.

After the AP transmits at least one packet including the initialization data to the LCM, the LCM may perform always on display by its own timing according to the initialization data, that is, the AP can go into a sleep state without performing drawing every minute, thus greatly reducing power consumption of the smart terminal during always on display.

However, since there is a certain error in the own timing of the LCM, the AP can timely update the reference time in the LCM at steps 202 and 203 for the accuracy of the system time of always on display. Of course, because some picture data in the transmitted initialization data may be updated according to the user's settings, the AP may also transmit the updated image to the LCM at steps 204 and 205 according to a certain strategy so as to update the corresponding data in the LCM.

In step 202, a system time is retrieved once every first preset time interval.

After the AP transmits at least one packet including the initialization data to the LCM, the LCM may start always on display according to the initialization data. When the LCM performs always on display, the LCM may obtain elapsed time by timing from the acquired system time through its own crystal oscillator, and the elapsed time and the acquired system time are added to obtain a system time to be displayed at each moment. However, since the timing by the crystal oscillator of LCM itself is not accurate enough, there is a certain error, a cumulative error may cause the resulting elapsed time to be inaccurate during always on display for a long time period, and in turn the accuracy of the current system time is affected. In this case, in order to prevent the deviation of the current system time displayed by the LCM caused by the overmuch cumulative error from being too large, the AP may be provided with a timer which retrieves a system time every the first preset time interval, so as to update the reference time previously received by the LCM.

It should be noted that the length of the first preset time interval may be set according to the characteristics of the crystal oscillator of the LCM. If the timing error of the crystal oscillator of the LCM is large, the first preset time interval may be set shorter correspondingly. On the contrary, if the timing error of the crystal oscillator of the LCM is small, the first preset time interval may be set longer. For example, the first preset time interval may be 1 hour or 3 hours, and is not limited by the present disclosure.

In step 203, a data packet including the retrieved system time is transmitted to the LCM via the MIPI protocol, and a value of the second field of the data packet including the retrieved system time is the fourth preset value.

After the AP retrieves a system time every the first preset time interval, the AP may transmit the retrieved system time to the LCM via the MIPI protocol.

The AP may transmit a data packet including the retrieved system time to the LCM via the MIPI protocol, in which the data packet may carry a first field and a second field. Since the retrieved system time included in the data packet is configured to update the reference time of the LCM, that is, the data included in the data packet are configured to update time, the AP may set a value of the second field carried in the data packet to be the fourth preset value, so as to identify the type of the data carried in the data packet to be time calibration data.

By steps 202 and 203, the AP may update the reference time of the LCM only within a certain time interval, that is, the AP does not have to draw and transmit an image once every minute after transmitting the initialization data to the LCM at a time, and it is only necessary to update the required contents in the initialization data after a certain time interval. It is not necessary to transmit the data that need not be updated. It can be seen that the period for updating data by the AP is clearly prolonged and the updated content required for transmission is also clearly reduced, an update manner is more flexible, and power consumption of the smart terminal is also reduced accordingly.

In step 204, whether picture data required for always on display are updated according to a preset period is detected.

After the AP transmits at least one data packet including the initialization data to the LCM, some picture data in the initialization data may be updated due to the user's setting, therefore, the AP may be provided with a timer and detect whether picture data required for always on display are updated according to a preset period.

The preset period may be one hour or two hours or the like, and may be set by the user according to his/her requirements, and is not particularly limited by the present disclosure.

Of course, for image data (e.g., a background image) in the initialization data, a plurality of image data may be simultaneously stored by the AP, and the AP may have been set to display according to which picture data at what time. In this case, it is not necessary to detect whether the picture data has been updated, but it is only necessary to update the image data to the LCM at regular intervals according to a preset time interval.

For example, there are three background images stored in the AP, in which a background image A is configured to display at 00:00-6:00, a background image B is configured to display at 6:00-18:00, and a background image C is configured to display at 18:00-00:00. If the time that the AP transmits the initialization data to LCM is between 6:00-18:00, the background image in the initialization data initially transmitted by the AP to the LCM is the background image B. After this, the AP provided with the timer can actively transmit the background image C to the LCM when reaching 18:00, so as to update the background image C stored in the LCM.

In step 205, a data packet including the updated picture data is transmitted to the LCM when it is detected that the picture data required for always on display are updated, a value of the second field of the data packet including the updated picture data is the fifth preset value.

If the AP detects that the picture data required for always on display has been updated according to the preset period, the AP may directly transmit the data packet including the updated picture data to the LCM via the MIPI protocol. A first field and a second field may be carried in the data packet. Since the data included in the data packet is configured to update part of the picture data stored in the LCM, the AP may set the value of the second field carried in the data packet to be a fifth preset value, so as to identify the data included in the data packet to be picture update data.

It should be noted that if one data packet is insufficient to carry the updated picture data, the AP may transmit the updated picture data to the LCM by transmitting a plurality of data packets. At this time, a value of the first field in the first data packet of the plurality of data packets is the first preset value and a value of the first field in the remaining data packets is the second preset value.

By steps 204 and 205, the AP may transmit the updated picture data to the LCM only within a certain time interval to correspondingly update the picture data in the LCM, that is, the AP does not have to draw and transmit an image once every minute after transmitting the initialization data to the LCM at a time, and it is only necessary to update the required contents in the initialization data after a certain time interval. It is not necessary to transmit the data that need not be updated. It can be seen that the period for updating data by the AP is clearly prolonged and the updated content required for transmission is also clearly reduced, an update manner is more flexible, and power consumption of the smart terminal is also reduced accordingly.

It should be noted that, when the AP transmits a data packet including the updated picture data to the LCM, it is also possible to transmit a time calibration data packet including the current system time to the LCM so that the picture data is correspondingly updated by the LCM while the stored reference time is also updated.

In aspects of the present disclosure, a dedicated first field and a dedicated second field are defined for an always on display function in a display command set DCS of the MIPI protocol. When at least one data packet including data required for always on display is transmitted by an AP to a LCM, the data packet may carry a first field and a second field configured to indicate the data packet to be a data packet for performing always on display and to indicate a type of data included in the data packet. That is, by means of the method according to aspects of the present disclosure, MIPI communication interfaces having an always on display function are unified, the AP and LCM can be developed by each manufacturer according to the unified communication interfaces so as to implement the always on display function, and thus the efficiency of research and development may be improved. Further, because the type of data included in the data packet may be indicated via the second field, the data required for always on display can be sub-packaged and transmitted by the AP according to the type of data, thus increasing flexibility of always on display.

In addition, in the aspects of the present disclosure, the AP does not have to draw and transmit an image once every minute after transmitting the initialization data to the LCM at a time, and it is only necessary to update the required contents (e.g., a reference time and part of the picture data) in the initialization data after a certain time interval. It is not necessary to transmit the data that need not be updated. It can be seen that the period for updating data by the AP is clearly prolonged and the updated content required for transmission is also clearly reduced, an update manner is more flexible, and power consumption of the smart terminal is also reduced accordingly.

After introduction of the method for always on display in the above aspects, a device for always on display will be described later by the following aspects.

Figure 3A:
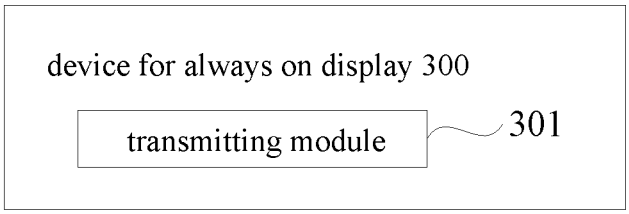
FIG. 3A is a block diagram of a device for always on display, according to an exemplary aspect of the present disclosure.

FIG. 3A is a block diagram of a device 300 for always on display, according to an exemplary aspect. Referring to FIG. 3A, the device includes a transmitting module 301.

The transmitting module 301 is configured to transmit at least one data packet to a LCM via a MIPI protocol, display an information content by the LCM through an always on display function based on the at least one data packet, the at least one data packet including data required for always on display, in which the data packet further carries a first field and a second field for each of the at least one data packet, the first field and the second field both are fields predefined for the always on display function in a display command set DCS of the MIPI protocol, the first field is configured to indicate the data packet to be a data packet for performing always on display, and the second field is configured to indicate a type of data included in the data packet.

Alternatively, a value of the first field is a first preset value or a second preset value, the first preset value is configured to indicate the data packet to be a first one of the at least one data packet, and the second preset value is configured to indicate the data packet to be a following data packet of a previous data packet adjacent to the data packet.

Alternatively, a value of the second field is a third preset value, a fourth preset value or a fifth preset value, the third preset value is configured to indicate the type of the data included in the data packet to be initialization data, the fourth preset value is configured to indicate the type of the data included in the data packet to be time calibration data, and the fifth preset value is configured to indicate the type of the data included in the data packet to be picture update data.

Alternatively, the transmitting module 301 is specifically configured to: transmit the at least one data packet to the LCM via the MIPI protocol when the initialization of the LCM is completed or the always on display function is enabled, in which the at least one data packet includes data required for always on display within a preset time period from a current system time, and the value of the second field of the at least one data packet is the third preset value.

Figure 3B:
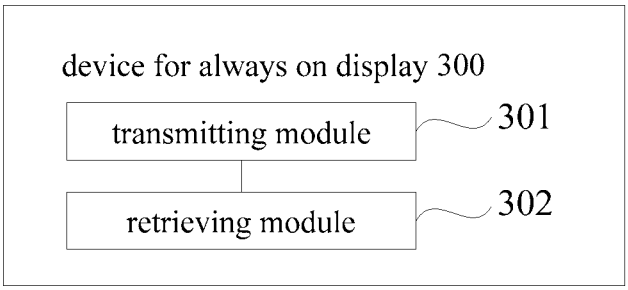
FIG. 3B is a block diagram of a device for always on display, according to an exemplary aspect of the present disclosure.

Alternatively, referring to FIG. 3B, the device 300 further includes: a retrieving module 302 configured to retrieve a system time once every first preset time interval, in which the transmitting module 301 is further configured to transmit a data packet including the retrieved system time to the LCM via the MIPI protocol, a value of the second field of the data packet including the retrieved system time being the fourth preset value.

Figure 3C:
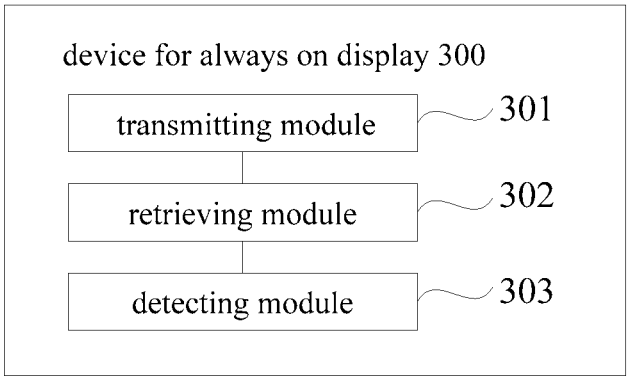
FIG. 3C is a block diagram of a device for always on display, according to an exemplary aspect of the present disclosure.

Alternatively, referring to FIG. 3C, the device 300 further includes: a detecting module 303 configured to detect whether picture data required for always on display are updated according to a preset period, in which the transmitting module 301 is further configured to transmit a data packet including the updated picture data to the LCM when it is detected that the picture data required for always on display are updated, a value of the second field of the data packet including the updated picture data being the fifth preset value.

With respect to the devices in the above aspects, the specific manners for performing operations for individual modules therein have been described in detail in the aspects regarding the methods for always on display, which will not be elaborated herein.

In an aspect of the present disclosure, a dedicated first field and a dedicated second field are defined for an always on display function in a display command set DCS of the MIPI protocol. When at least one data packet including data required for always on display is transmitted by an AP to a LCM, the data packet may carry a first field and a second field configured to indicate the data packet to be a data packet for performing always on display and to indicate a type of data included in the data packet. That is, by means of the method according to aspects of the present disclosure, MIPI communication interfaces having an always on display function are unified, the AP and LCM can be developed by each manufacturer according to the unified communication interfaces so as to implement the always on display function, and thus the efficiency of research and development may be improved. Further, because a type of data included in the data packet may be indicated via the second field, the data required for always on display can be sub-packaged and transmitted by the AP according to the type of data, thus increasing flexibility of always on display.

Figure 4:
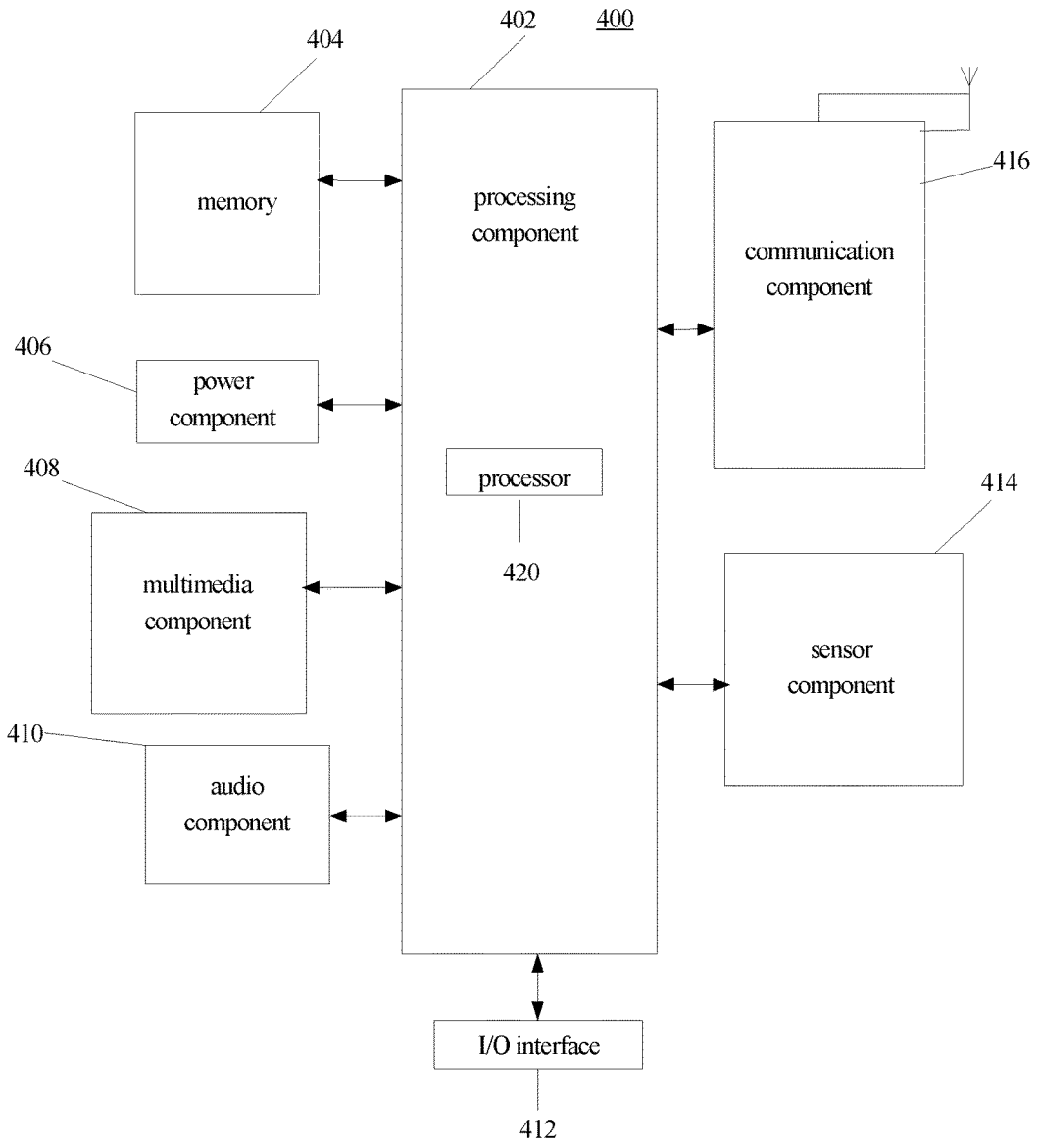
FIG. 4 is a block diagram of a device for always on display, according to an exemplary aspect of the present disclosure.

FIG. 4 is a block diagram of a device 400 for always on display, according to an exemplary aspect. For example, the device 400 may be a mobile phone, a computer, a digital broadcast terminal, a messaging device, a gaming console, a tablet, a medical device, exercise equipment, a personal digital assistant, and the like.

Referring to FIG. 4, the device 400 may include one or more of the following components: a processing component 402, a memory 404, a power component 406, a multimedia component 408, an audio component 410, an input/output (I/O) interface 412, a sensor component 414, and a communication component 416.

The processing component 402 typically controls overall operations of the device 400, such as the operations associated with display, telephone calls, data communications, camera operations, and recording operations. The processing component 402 may include one or more processors 420 to execute instructions to perform all or part of the steps in the above described methods. Moreover, the processing component 402 may include one or more modules which facilitate the interaction between the processing component 402 and other components. For instance, the processing component 402 may include a multimedia module to facilitate the interaction between the multimedia component 408 and the processing component 402.

The memory 404 is configured to store various types of data to support the operation of the device 400. Examples of such data include instructions for any applications or methods operated on the device 400, contact data, phonebook data, messages, pictures, video, etc. The memory 404 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 406 provides power to various components of the device 400. The power component 406 may include a power management system, one or more power sources, and any other components associated with the generation, management, and distribution of power in the device 400.

The multimedia component 408 includes a screen providing an output interface between the device 400 and the user. In some aspects, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some aspects, the multimedia component 408 includes a front camera and/or a rear camera. The front camera and the rear camera may receive an external multimedia datum while the device 400 is in an operation mode, such as a photographing mode or a video mode. Each of the front camera and the rear camera may be a fixed optical lens system or have focus and optical zoom capability.

The audio component 410 is configured to output and/or input audio signals. For example, the audio component 410 includes a microphone ("MIC") configured to receive an external audio signal when the device 400 is in an operation mode, such as a call mode, a recording mode, and a voice recognition mode. The received audio signal may be further stored in the memory 404 or transmitted via the communication component 416. In some aspects, the audio component 410 further includes a speaker to output audio signals.

The I/O interface 412 provides an interface between the processing component 402 and peripheral interface modules, such as a keyboard, a click wheel, buttons, and the like. The buttons may include, but are not limited to, a home button, a volume button, a starting button, and a locking button.

The sensor component 414 includes one or more sensors to provide status assessments of various aspects of the device 400. For instance, the sensor component 414 may detect an open/closed status of the device 400, relative positioning of components, e.g., the display and the keypad, of the device 400, a change in position of the device 400 or a component of the device 400, a presence or absence of user contact with the device 400, an orientation or an acceleration/deceleration of the device 400, and a change in temperature of the device 400. The sensor component 414 may include a proximity sensor configured to detect the presence of nearby objects without any physical contact. The sensor component 414 may also include a light sensor, such as a CMOS or CCD image sensor, for use in imaging applications. In some aspects, the sensor component 414 may also include an accelerometer sensor, a gyroscope sensor, a magnetic sensor, a pressure sensor, or a temperature sensor.

The communication component 416 is configured to facilitate communication, wired or wirelessly, between the device 400 and other devices. The device 400 can access a wireless network based on a communication standard, such as WiFi, 2G, or 3G, or a combination thereof. In one exemplary aspect, the communication component 416 receives a broadcast signal or broadcast associated information from an external broadcast management system via a broadcast channel. In one exemplary aspect, the communication component 416 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary aspects, the device 400 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the methods in the aspects shown in FIGS. 1-2.

In exemplary aspects, there is also provided a non-transitory computer-readable storage medium including instructions, such as included in the memory 404, executable by the processor 420 in the device 400, for performing the above-described methods. For example, the non-transitory computer-readable storage medium may be a ROM, a RAM, a CD-ROM, a magnetic tape, a floppy disc, an optical data storage device, and the like.

A non-temporary computer-readable storage medium has stored therein instructions that, when executed by a processor of a mobile terminal, causes the mobile terminal to perform a method for always on display. The method for always on display includes: transmitting at least one data packet to a liquid crystal display module LCM via a mobile industry processor interface MIPI protocol, and displaying an information content by the LCM through an always on display function based on the at least one data packet, the at least one data packet including data required for always on display, in which the data packet further carries a first field and a second field for each of the at least one data packet, the first field and the second field both are fields predefined for the always on display function in a display command set DCS of the MIPI protocol, the first field is configured to indicate the data packet to be a data packet for performing always on display, and the second field is configured to indicate a type of data included in the data packet.

Alternatively, a value of the first field is a first preset value or a second preset value, the first preset value is configured to indicate the data packet to be a first one of the at least one data packet, and the second preset value is configured to indicate the data packet to be a following data packet of a previous data packet adjacent to the data packet.

Alternatively, a value of the second field is a third preset value, a fourth preset value or a fifth preset value, the third preset value is configured to indicate the type of the data included in the data packet to be initialization data, the fourth preset value is configured to indicate the type of the data included in the data packet to be time calibration data, and the fifth preset value is configured to indicate the type of the data included in the data packet to be picture update data.

Alternatively, transmitting the at least one data packet to the liquid crystal display module LCM via the mobile industry processor interface MIPI protocol includes: transmitting the at least one data packet to the LCM via the MIPI protocol when the initialization of the LCM is completed or the always on display function is enabled, in which the at least one data packet includes data required for always on display within a preset time period from a current system time, and the value of the second field of the at least one data packet is the third preset value.

Alternatively, after transmitting the at least one data packet to the LCM via the MIPI protocol, the method further includes: retrieving a system time once every first preset time interval; transmitting a data packet including the retrieved system time to the LCM via the MIPI protocol, a value of the second field of the data packet including the retrieved system time being the fourth preset value.

Alternatively, after transmitting the at least one data packet to the LCM via the MIPI protocol, the method further includes: detecting whether picture data required for always on display are updated according to a preset period; and transmitting a data packet including the updated picture data to the LCM when it is detected that the picture data required for always on display are updated, a value of the second field of the data packet including the updated picture data being the fifth preset value.

In aspects of the present disclosure, a dedicated first field and a dedicated second field are defined for an always on display function in a display command set DCS of the MIPI protocol. When at least one data packet including data required for always on display is transmitted by an AP to a LCM, the data packet may carry a first field and a second field configured to indicate the data packet to be a data packet for performing always on display and to indicate a type of data included in the data packet. That is, by means of the method according to aspects of the present disclosure, MIPI communication interfaces having an always on display function are unified, the AP and LCM can be developed by each manufacturer according to the unified communication interfaces so as to implement the always on display function, and thus the efficiency of research and development may be improved. Further, because a type of data included in the data packet may be indicated via the second field, the data required for always on display can be sub-packaged and transmitted by the AP according to the type of data, thus increasing flexibility of always on display.

In the above aspects, it may be implemented in all or in part by software, hardware, firmware, or any combination thereof. When implemented by software, it may be implemented in all or in part in a form of a computer program product. The computer program product includes one or more computer instructions. The process or function described in the aspects of the present disclosure is generated in all or in part, when the computer instructions are loaded and executed on a computer. The computer may be a general purpose computer, a dedicated computer, a computer network, or other programmable devices. The computer instructions may be stored in a computer-readable storage medium or transmitted from one computer-readable storage medium to another computer-readable storage medium, for example, transmitted from a website, a computer, a server, or a data center to another web site, computer, server, or data center in a wired mode (such as coaxial cable, optical fibre, digital subscriber line (DSL)) or a wireless mode (e.g., infrared mode, wireless mode, microwave mode, etc.). The computer-readable storage medium may be any available medium that the computer can access or a data storage device (such as a server, a data center, etc.) containing one or more integrated available mediums. The available medium may be a magnetic medium (e.g., a floppy disk, a hard disk, a magnetic tape), an optical medium (e.g., Digital Versatile Disc (DVD)), or a semiconductor medium (e.g., Solid State Disk (SSD)), etc.

It is noted that the various modules, sub-modules, units, and components in the present disclosure can be implemented using any suitable technology. For example, a module may be implemented using circuitry, such as an integrated circuit (IC). As another example, a module may be implemented as a processing circuit executing software instructions.

Other aspects of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. A method for always on display, being applicable to an application processor (AP), the method comprising:

transmitting at least one data packet to a liquid crystal display module (LCM) via a mobile industry processor interface (MIPI) protocol; and displaying an information content by the LCM through an always on display function based on the at least one data packet that includes data required for always on display, wherein the data packet further includes a first field and a second field for each of the at least one data packet, the first field and the second field both are fields predefined for the always on display function in a display command set (DCS) of the MIPI protocol, the first field is configured to indicate the data packet to be a data packet for performing always on display, and the second field is configured to indicate a type of data included in the data packet, and wherein transmitting the at least one data packet to the LCM via the MIPI protocol includes transmitting the at least one data packet to the LCM via the MIPI protocol when initialization of the LCM is completed or the always on display function is enabled, wherein the at least one data packet comprises data required for always on display within a preset time period from a current system time, and a value of the second field of the at least one data packet is a first preset value that is configured to indicate the type of the data included in the data packet to be initialization data.

2. The method of claim 1, wherein a value of the first field is a first preset value or a second preset value, the first preset value is configured to indicate the data packet to be a first one of the at least one data packet, and the second preset value is configured to indicate the data packet to be a following data packet of a previous data packet adjacent to the data packet.

3. The method of claim 1, wherein the value of the second field is the first preset value, a second preset value or a third preset value, the first preset value is configured to indicate the type of the data included in the data packet to be initialization data, the second preset value is configured to indicate the type of the data included in the data packet to be time calibration data, and the third preset value is configured to indicate the type of the data included in the data packet to be picture update data.

4. The method of claim 3, wherein after transmitting the at least one data packet to the LCM via the MIPI protocol, the method further comprises:

retrieving a system time once every first preset time interval; and transmitting a data packet comprising the retrieved system time to the LCM via the MIPI protocol, a value of the second field of the data packet comprising the retrieved system time being the second preset value.

5. The method of claim 3, wherein after transmitting the at least one data packet to the LCM via the MIPI protocol, the method further comprises:

detecting whether picture data required for always on display are updated according to a preset period; and transmitting a data packet comprising the updated picture data to the LCM when it is detected that the picture data required for always on display are updated, a value of the second field of the data packet comprising the updated picture data being the third preset value.

6. A device for always on display, comprising:

a processor; and a memory for storing instructions executable by the processor, wherein the processor is configured to:

transmit at least one data packet to a liquid crystal display module (LCM) via a mobile industry processor interface (MIPI) protocol; and display an information content by the LCM through an always on display function based on the at least one data packet that includes data required for always on display, wherein the data packet further includes a first field and a second field for each of the at least one data packet, the first field and the second field both are fields predefined for the always on display function in a display command set (DCS) of the MIPI protocol, the first field is configured to indicate the data packet to be a data packet for performing always on display, and the second field is configured to indicate a type of data included in the data packet, and wherein, when transmitting the at least one data packet to the LCM via the MIPI protocol, the processor is further configured to transmit the at least one data packet to the LCM via the MIPI protocol when initialization of the LCM is completed or the always on display function is enabled, wherein the at least one data packet comprises data required for always on display within a preset time period from a current system time, and a value of the second field of the at least one data packet is a first preset value that is configured to indicate the type of the data included in the data packet to be initialization data.

7. The device according to claim 6, wherein a value of the first field is a first preset value or a second preset value, the first preset value is configured to indicate the data packet to be a first one of the at least one data packet, and the second preset value is configured to indicate the data packet to be a following data packet of a previous data packet adjacent to the data packet.

8. The device according to claim 6, wherein the value of the second field is the first preset value, a second preset value or a third preset value, the first preset value is configured to indicate the type of the data included in the data packet to be initialization data, the second preset value is configured to indicate the type of the data included in the data packet to be time calibration data, and the third preset value is configured to indicate the type of the data included in the data packet to be picture update data.

9. The device according to claim 8, wherein after transmitting the at least one data packet to the LCM via the MIPI protocol, the processor is further configured to:

retrieve a system time once every first preset time interval; and transmit a data packet comprising the retrieved system time to the LCM via the MIPI protocol, a value of the second field of the data packet comprising the retrieved system time being the second preset value.

10. The device according to claim 8, wherein after transmitting the at least one data packet to the LCM via the MIPI protocol, the processor is further configured to:

detect whether picture data required for always on display are updated according to a preset period; and transmit a data packet comprising the updated picture data to the LCM when it is detected that the picture data required for always on display are updated, a value of the second field of the data packet comprising the updated picture data being the third preset value.

11. A non-transitory computer-readable storage medium having stored therein instructions that, when executed by a processor one or more processors of a computing device, cause the computing device to:

transmit at least one data packet to a liquid crystal display module (LCM) via a mobile industry processor interface (MIPI) protocol; and display an information content by the LCM through an always on display function based on the at least one data packet that includes data required for always on display, wherein the data packet further includes a first field and a second field for each of the at least one data packet, the first field and the second field both are fields predefined for the always on display function in a display command set (DCS) of the MIPI protocol, the first field is configured to indicate the data packet to be a data packet for performing always on display, and the second field is configured to indicate a type of data included in the data packet, and wherein, when transmitting the at least one data packet to the LCM via the MIPI protocol, the instructions further cause the computing device to transmit the at least one data packet to the LCM via the MIPI protocol when initialization of the LCM is completed or the always on display function is enabled, wherein the at least one data packet comprises data required for always on display within a preset time period from a current system time, and a value of the second field of the at least one data packet is a first preset value that is configured to indicate the type of the data included in the data packet to be initialization data.

* * * * *